US006543405B2

(12) United States Patent
Sachdev et al.

(10) Patent No.: US 6,543,405 B2
(45) Date of Patent: Apr. 8, 2003

(54) MODULAR ENGINE ARCHITECTURE

(75) Inventors: Anil Kumar Sachdev, Rochester Hills, MI (US); Chin-Hsiu Li, Bloomfield Hills, MI (US); Alexander Millerman, Bloomfield Hills, MI (US); Yhu-Tin Lin, Rochester Hills, MI (US); Brian Daniel Kaminski, Lake Orion, MI (US); Thomas J. Klakulak, Washington, MI (US)

(73) Assignee: General Motors Corporation, Detroit, MI (US)

( * ) Notice: Subject to any disclaimer, the term of this patent is extended or adjusted under 35 U.S.C. 154(b) by 0 days.

(21) Appl. No.: 09/924,930

(22) Filed: Aug. 8, 2001

(65) Prior Publication Data

US 2003/0029413 A1 Feb. 13, 2003

(51) Int. Cl.[7] ..... F02F 7/00
(52) U.S. Cl. ..... 123/195 R
(58) Field of Search ..... 123/195 R, 195 H, 123/41.74, 193.2

(56) References Cited

U.S. PATENT DOCUMENTS 1,357,538 A * 11/1920 Bentley ..... 123/195 R
1,433,821 A * 10/1922 Hull ..... 123/195 R
5,509,387 A * 4/1996 Kaminski et al. ..... 123/195 R

FOREIGN PATENT DOCUMENTS

| | | |
|---|---|---|
| WO | 98/40188 | 9/1988 |
| WO | 98/40608 | 9/1998 |

* cited by examiner

*Primary Examiner*—Gene Mancene
*Assistant Examiner*—Hyder Ali
(74) *Attorney, Agent, or Firm*—Kathryn A. Marra

(57) ABSTRACT

An automotive reciprocating engine design is disclosed preferably including an extruded cylinder bore block with cylinder bores and a surrounding coolant passage extending from a top flat surface to a bottom flat surface; a cast, closed bottom, open top crankcase with vertical walls having flat upper surfaces; and a stamped metal mid-plate interposed in sealing relationship between the bottom surface of the cylinder block and the flat top surfaces of the crankcase. The crankcase contains bearing supports for a crankshaft and the mid-plate contains holes for connecting rods attached to pistons in the cylinder bores. The design facilitates low cost manufacture of strong, light weight components and easier assembly of the engine, and permits flexible manufacture of a family of engines with different displacements by substitution of a cylinder block of different length or of different bore diameter.

12 Claims, 5 Drawing Sheets

MODULAR ENGINE ARCHITECTURE

TECHNICAL FIELD

This invention pertains to the design of reciprocating internal combustion engines for simplified manufacturing. More specifically, this invention pertains to an engine component design which permits the flexible manufacture of engines of similar but varying cylinder bore and piston stroke dimensions.

BACKGROUND OF THE INVENTION

The modern four cycle, spark ignition, gasoline powered automobile engine is an elegant and increasingly fuel-efficient machine. Because of the wide ranging needs of vehicle owners, engines of widely different torque and power outputs must be produced. But each different engine size (or displacement) is of complicated construction and requires a large investment to design and manufacture.

In simplest terms, these internal combustion engines comprise a plurality of round pistons reciprocating within cylindrical bores and connected to a crankshaft with connecting rods. During a combustion pressure induced power stroke each piston applies torque to the crankshaft to provide the motive power of the engine. The torque and power delivered through the crankshaft is a function of the pressure surface area of the pistons and the length of their power strokes.

This assembly of pistons, connecting rods and crankshaft is housed in an engine block. The engine block defines the cylinders in which the pistons reciprocate and it locates and supports the crankshaft and connecting rods. It is open at the bottom. The pistons, connecting rods and crankshaft are assembled from the bottom of the block after inverting it. Finally the bottom of the block is closed with an oil pan. The engine block also contains engine coolant and lubricating oil passages. A cylinder head closes the tops of the cylinders in the block to define therein each respective combustion chamber with the enclosed piston head. The cylinder head also typically contains two air or fuel/air inlet ports and valves, two exhaust gas ports and valves, a spark plug and, often, a fuel injector. It also contains coolant and oil passages. Both the engine block and the cylinder head are metal castings of complex design. And each casting must be designed for the specified displacement of the engine.

As observed, it is very expensive to manufacture such engines with specifically designed and cast engine blocks and cylinder heads. It is foreseen that large savings could be realized in the manufacture of automobile engines if the design and manufacture of the engine block could be simplified. It is an object of this invention to provide a modular approach to making the engine structural components that contain the piston, connecting rod, and crankshaft assembly. It is a further object of the invention to separate the cylinder block portion of engine construction from the crankcase containing and assembling portion of the engine.

SUMMARY OF THE INVENTION

This invention focuses on the redesign of the engine block and oil pan portion of current automobile engines. Current production engines consist of a cylinder head and an engine block. These two components are bolted together with a head gasket in-between for sealing purposes. This configuration has been in production since internal combustion engines became available. The engine block itself is a big casting and requires a new design when either the bore diameter or stroke of the engine is changed. The production of a new engine block requires substantial tooling costs and its design delays new engine development.

This invention provides a new modularity in constructing automotive engines. In accordance with the invention, conceptually the current engine block is divided into two distinct sections: an upper cylinder bore block, which is preferably an extrusion, and a lower crankcase which will typically be a casting. The extruded cylinder block defines the cylinder bores and provides coolant passages around the cylinders. It has flat upper and lower surface portions for sealing purposes which will be described. The cast crankcase is shaped to contain and support the crankshaft and its bearing supports and bearing caps. It contains a closed bottom and side walls for these purposes. The side walls end in flat top surfaces also for a sealing function. A mid-plate separates the cylinder block and crankcase structures and provides openings for the connecting rods joining the pistons in the respective cylinder bores to the crankshaft in the crankcase.

The upper surface of the mid-plate has a gasket shaped to seal coolant in the cylinder block while the bottom surface of the mid-plate has another gasket to seal oil and blow-by gases in the crankcase. The mid-plate separator thus allows a single crankcase to be matched with varying sizes of cylinder bores for a family of engines.

The overall engine architecture then includes a conventional cylinder head and the extruded cylinder block and separate closed crankcase provided by this invention. A head gasket provides sealing between the cylinder head and upper surface of the cylinder block. Gaskets on both sides of the mid-plate provide sealing between the cylinder block and mid-plate and between the mid-plate and crankcase. These engine structural components from cylinder head to crankcase are bolted together by a set of long bolts into a suitably rigid and strong structure.

The open top of the crankcase permits easy placement of the crankshaft on its bearing supports and the positioning of the bearing caps on the journals of the crankshaft. Moreover, the continuous cylinder openings through the length of the extruded cylinder block and the cooperating holes in the mid-plate permit easy assembly of the connecting rods and pistons in and between the cylinder block and crankcase. Such placements and assembly can be accomplished without turning the engine over during this part of its construction. And the architecture requires no oil pan.

Generally, both the cylinder head and crankcase are cast parts. But the cylinder bore block is preferably an extrusion and can be cut to the length to meet the piston stroke needed. Extruded alloys are often stronger than cast alloys and, therefore, extrusions can sometimes be made smaller and lighter then the same part made by casting. Further, cylinder block extrusions can be made with lower cost tooling than cast blocks and can be extruded to close to net shape, thus requiring less machining.

With the cylinder bore block and crankcase being separated by the mid-plate, the sizes of the cylinder bores or lengths in a cylinder block are not rigidly tied to a specific crankcase or even a specific cylinder head. The selection of bore diameter and stroke may be limited by valve size, valve bridge width (e.g., minimum of 4 mm) or bore wall distance (e.g., minimum of 5.5 mm). Under these constraints, a modular engine construction as provided by this invention can accommodate approximately a 40% variation in engine displacement using the same cylinder head and crankcase.

Thus, a modular engine architecture as provided herein can be utilized for designing and manufacturing a family of engines where the engine displacements vary within a range, for example 1.8 L, 2.0 L, and 2.2 L. For these three engines, a manufacturer could use the same cylinder head, crankcase, mid-plate and the gasket for lower mid-plate surface. Variations in engine displacement can be achieved by varying bore diameter, piston stroke, or a combination of both, in the extrusion of the cylinder block, which would be a commodity part. This family of engines could be produced on the same production line. The number of engines produced for each displacement could be quickly tuned to reflect the market needs for these engines.

The use of the extruded cylinder bore block and cast crankcase is also applicable in V-engine designs. In this embodiment, two extruded cylinder blocks would be bolted through two mid-plates to a single crankcase having wall sections to seal against the two V-legs formed by the cylinder blocks. The bearing caps would be shaped to accommodate this architecture.

In preferred embodiments of the invention, water cooling of the cylinder head and the cylinder block are managed separately. An electric water pump is employed with water flow circuits that enable the head and cylinder blocks to be cooled independent of engine speed and of each other. The object of this arrangement is to maintain uniform engine temperature at all speeds.

Just as different engine segments can be cooled with different coolant flow rates, lubricant flow to the cylinder head and the crankcase can also be separately controlled using an oil pump mounted outside the engine structure.

Other objects and advantages of the invention will become apparent from a detailed description of a preferred embodiment which follows.

BRIEF DESCRIPTION OF THE DRAWINGS

When a part is shown in different drawing figures it is identified by the same number.

DESCRIPTION OF THE PREFERRED EMBODIMENT

The practice of the invention will be illustrated in the case of an in-line, four-cylinder, spark ignition engine. Engines of this type are manufactured in large numbers throughout the world. Moreover, they are designed and manufactured with displacement values that vary over a relatively narrow range, for example, 1.8 to 2.2 liters. In accordance with this invention, a family of engines with similar modular components could be designed and manufactured at relatively low cost and capital investment. In a preferred, but optional, embodiment the illustrated design contemplates detached engine accessories such as the oil pump, water pump, starter and alternator.

Figure 1:
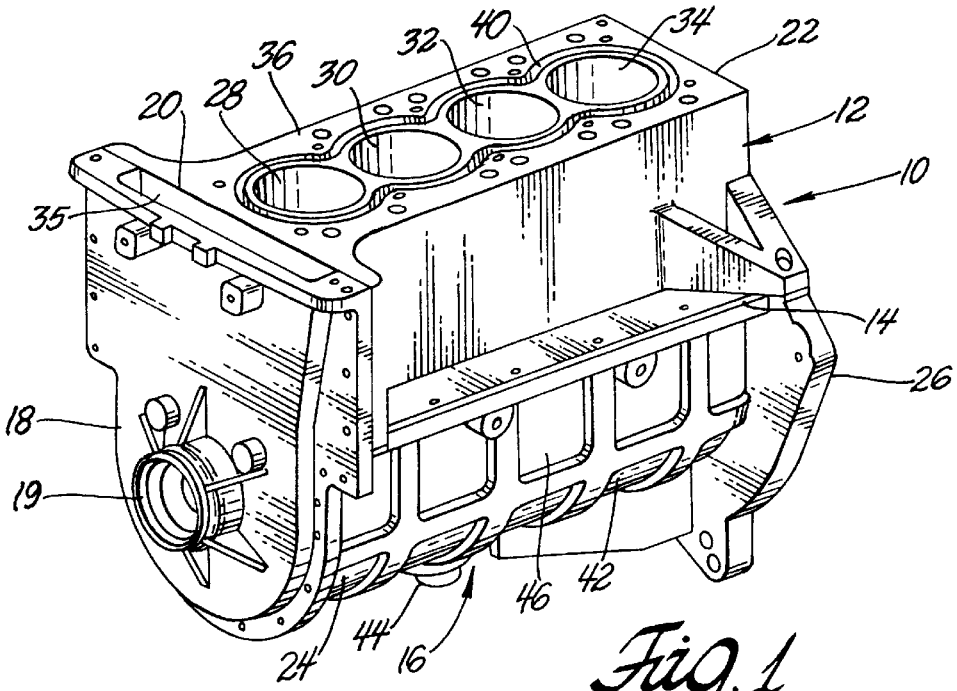
FIG. 1 is a perspective assembly view of a modular engine architecture comprising an extruded cylinder bore block, a mid-plate and cast crankcase in assembled relationship. A front engine cover casting for enclosing a timing chain is illustrated in the FIG. 1 view.

In FIG. 1 an assembly 10 of modular engine structural components is illustrated. The assembly 10 includes an extruded cylinder bore block 12 that has a front end 20 (referring to the arrangement in FIG. 1) and a rear end 22. Below the cylinder block 12 is a crankcase 16 that also has a front end 24 and rear end 26. Cylinder block 12 and crankcase 16 are separated by mid-plate 14. Enclosing the front of the engine (as shown in FIG. 1) is engine cover 18. As shown cylinder block 12 has four cylindrical bores 28, 30, 32, and 34, respectively, from the front 20 to the rear 22 of the cylinder block.

The cylinder block 12, crankcase 16, and mid-plate 14 are structural parts of the modular engine architecture of this invention. In an assembled engine these parts cooperate to enclose a crankshaft in crankcase 16, four pistons in cylinder bores 28, 30, 32, 34 and four connecting rods extending from the cylinder bores through holes (74, in FIG. 4) in midplate 14 into crankcase 16. In order to simplify the illustration of the modular engine elements of this invention, the pistons, connecting rods and crankshaft are not shown. These engine components are well known and neither their design nor manufacture need be changed by the practice of this invention.

Front plate 18 forms a space 35 between the front end 20 of cylinder block 12 and front end 24 of crankcase 16 to accommodate a timing sprocket and timing chain. These parts are not shown in FIG. 1. But as is well known, the timing sprocket is turned by one end of the crankshaft and drives a timing chain that drives a camshaft for intake and exhaust valve actuation. Front plate 18 also provides a bearing support opening 19 for the front end of the crankshaft.

The top surface 36 of cylinder bore block 12 is flat for sealing engagement with a cylinder head, not shown. Again, as is well known, the cylinder head of the engine closes the top of the cylinder bores 28–34 to provide a combustion chamber in each bore in cooperation with the respective piston reciprocating in the bore. The cylinder head contains inlet and exhaust ports, and positions and supports intake and exhaust valves. The cylinder head also contains a spark plug, in the case of a spark ignition engine, and it often contains a fuel injector. The cylinder head and its components are not illustrated, for purposes of simplicity of disclosure, because their design, construction and operation does not necessarily have to be altered by the use of the modular engine components of this invention.

Figure 2:
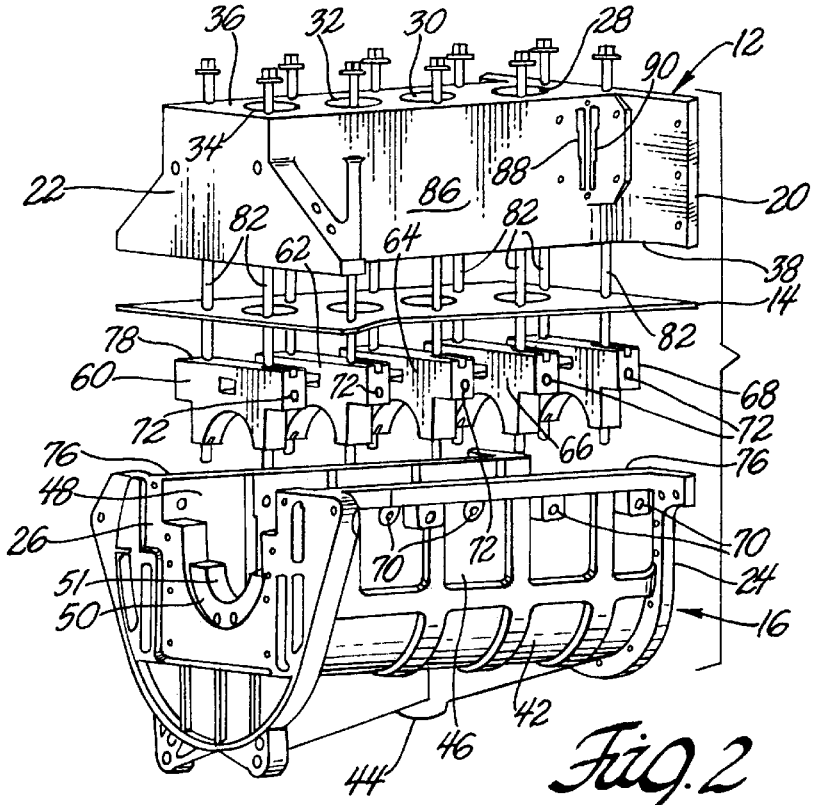
FIG. 2 is an exploded view of several of the modular engine elements of FIG. 1. In this figure the elements are shown turned end-for-end from their position in FIG. 1 for further illustration.

FIG. 2 shows cylinder block 12, mid-plate 14 and crankcase 16 turned end-for-end and in exploded view. In this view (and in FIGS. 1 and 3), cylinder bore block 12 is recognizable as an extruded article of manufacture. Its vertical surfaces extending from top surface 36 to bottom surface 38 are straight. The cylinder bores 28–34 and cooling passage 40 also extend vertically straight throughout their length. Cylinder block 12 may be extruded using an aluminum alloy such as AA6063.

Figure 5:
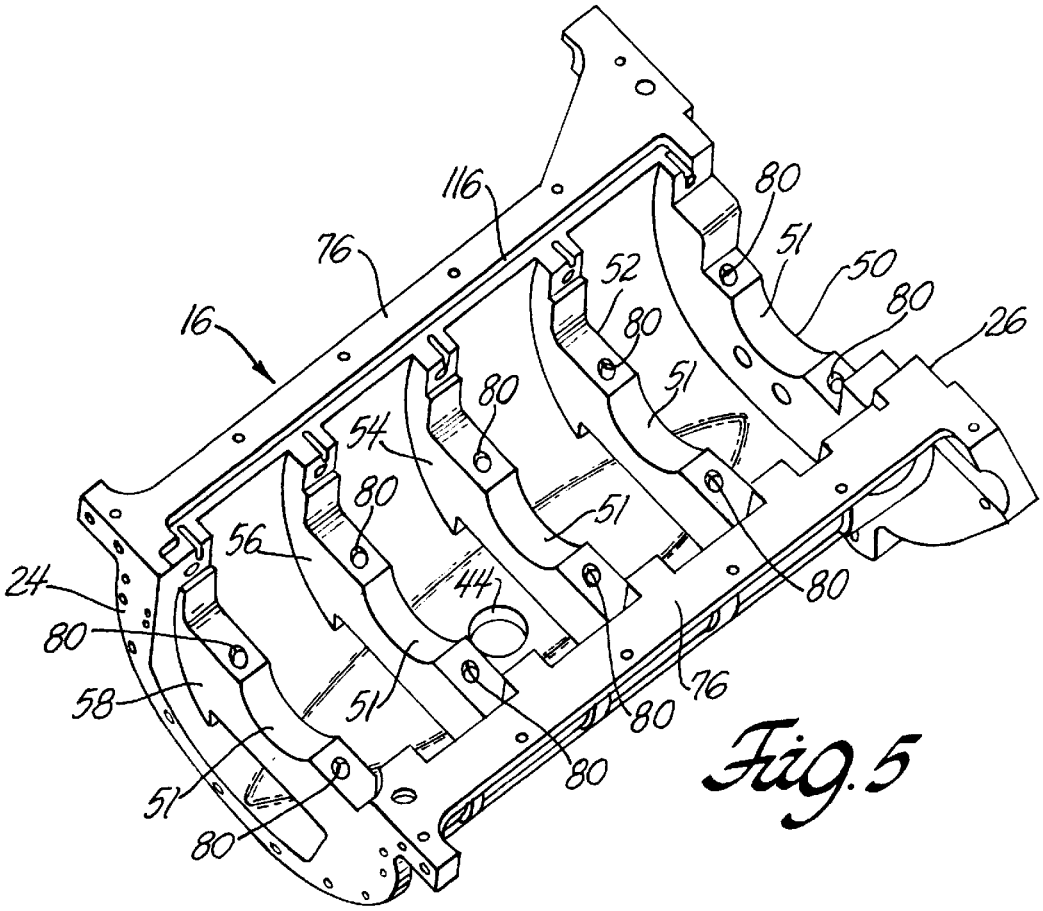
FIG. 5 is a top perspective view of the cast crankcase modular element of FIGS. 1 and 2.

Crankcase 16 is preferably a casting of suitable aluminum or ferrous alloy. It is basically an elongated bowl structure, symmetrical about its central longitudinal vertical plane. Its rounded bottom 42 is closed, except for an oil drain hole 44. The length and spacing of sidewalls 46 and 48 accommodate the crankshaft for the four cylinder engine. The journals of the crankshaft are supported on semi-circular cradle portions 51 of bearing supports 50 (as seen in FIG. 2) and bearing supports 52, 54, 56 and 58 as best seen in FIG. 5. Preferably, these five bearing supports are integrally cast portions of crankcase 16.

Referring to FIG. 2 the upper halves of the bearing structures for the crankshaft are bearing caps 60, 62, 64, 66 and 68. They are shown in exploded view prior to engine assembly. Thus, in the assembly of the engine, a crankshaft with connecting rods attached can be readily laid on bearing supports 50–58 through the open top of the crankcase structure. Bearing caps 60, 62, 64, 66, 68 are then placed upon the respective bearing supports on top of the journals of the crankshaft. The bearing caps are secured partly by five bolts on each side of the crankcase extending through bolt holes 70 into complementary holes 72 in the ends of the bearing caps. This assembly is easily accomplished through the open top of the crankcase 16.

Figure 4:
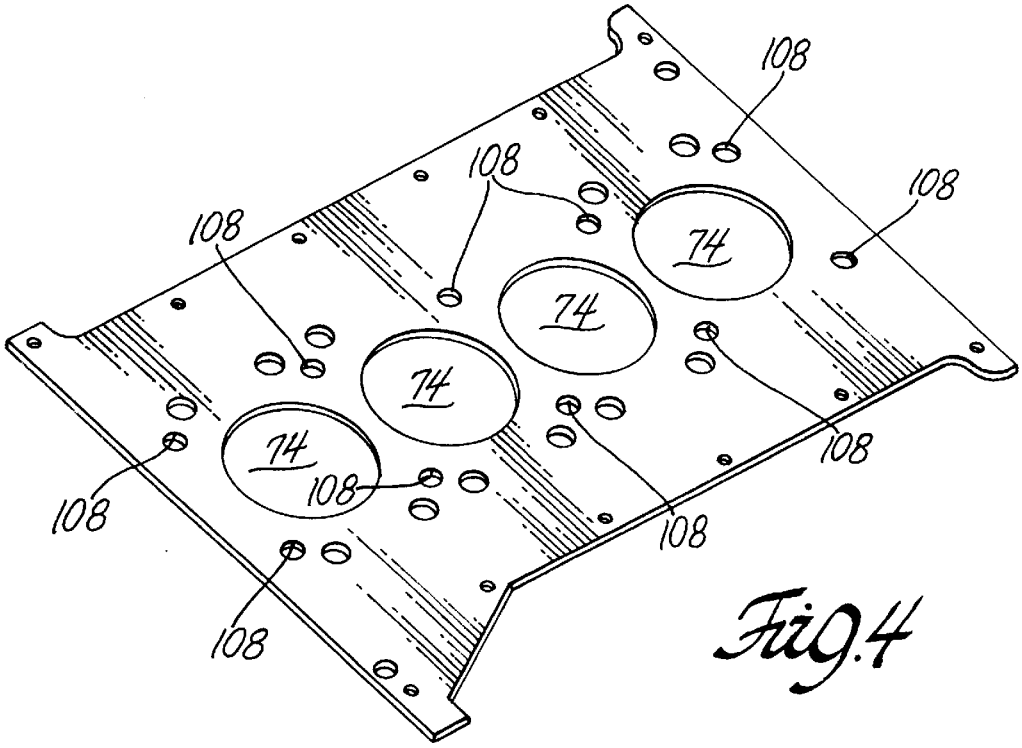
FIG. 4 is a perspective view of the mid-plate element of FIGS. 1 and 2.

Mid-plate 14 is then laid on top of the bearing caps 60–68. As seen in FIGS. 2 and 4, the mid-plate has holes 74 for the extension of the connecting rods from the crankshaft in the crankcase 16 up into the cylinder bores 28–34 of the cylinder block 12. Pistons can then be inserted into the bores 28–34 and the cylinder block 12 placed on top of the mid-plate 14 which in turn rests on the top surfaces 76 of walls 46, 48 of the crankcase 16 and the top surfaces 78 of bearing caps 60, 62, 64, 66, 68 (see also FIG. 6). As best seen in exploded view FIG. 2, ten bolts 82 of suitable length extend through the cylinder block 12, mid-plate 14, and bearing caps 60–68 and are screwed into and anchored in the bearing support portions 50–58 of the crankcase 16. In FIG. 5, ten threaded bolt holes 80 in the respective bearing supports receive the bolts 82. Actually, in the assembly of an engine these through bolts 82 could also extend through the cylinder head (not shown) to be located on top of the cylinder block 12.

Thus, FIG. 2 illustrates, in uncluttered outline, the relative positions of the modular structural engine elements of this invention. In an engine assembly operation, a gasket would be inserted between the cylinder head and the extruded cylinder bore block 12. Also in the assembled engine there would be a gasket (not shown) on top of mid-plate 14 to provide a coolant seal between mid-plate 14 and the lower surface 38 of the cylinder block 12. Similarly a second gasket (not shown) would be located as a lubricating oil seal below mid-plate 14 on the top surfaces 76 of the crankcase 16. In a preferred embodiment, mid-plate 14 is stamped from a stainless steel sheet and thin sheets (0.25 mm) of coated steel gasket material are riveted or welded to each side of the plate.

Figure 3A:
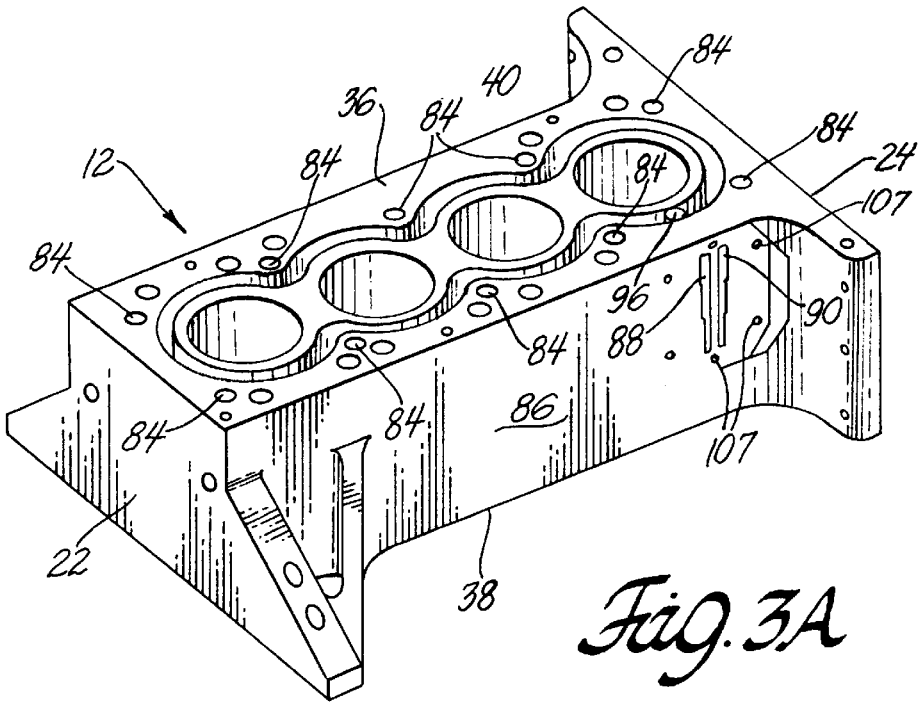
FIG. 3A is a perspective view of the extruded cylinder bore block of FIGS. 1 and 2.

FIG. 3A is a perspective of the cylinder bore block 12. It shows the cylinder bores 28, 30, 32, 34 with the surrounding cooling passage 40. Bolt holes 84 for through bolts 82 are shown as well as additional bolt holes for rigidly securing the cylinder block to mid-plate 14 and crankcase 16. Machined in the side 86 wall of cylinder bore block 12 are an engine coolant inlet slot 88 and a coolant outlet slot 90. Coolant slots 88 and 90 extend through wall 86 to region of the coolant passage 40 on the immediate opposite side of the wall 86. Bolt holes 107 are for attaching a coolant inlet/outlet manifold casting 94, shown in FIG. 8.

Figure 3B:
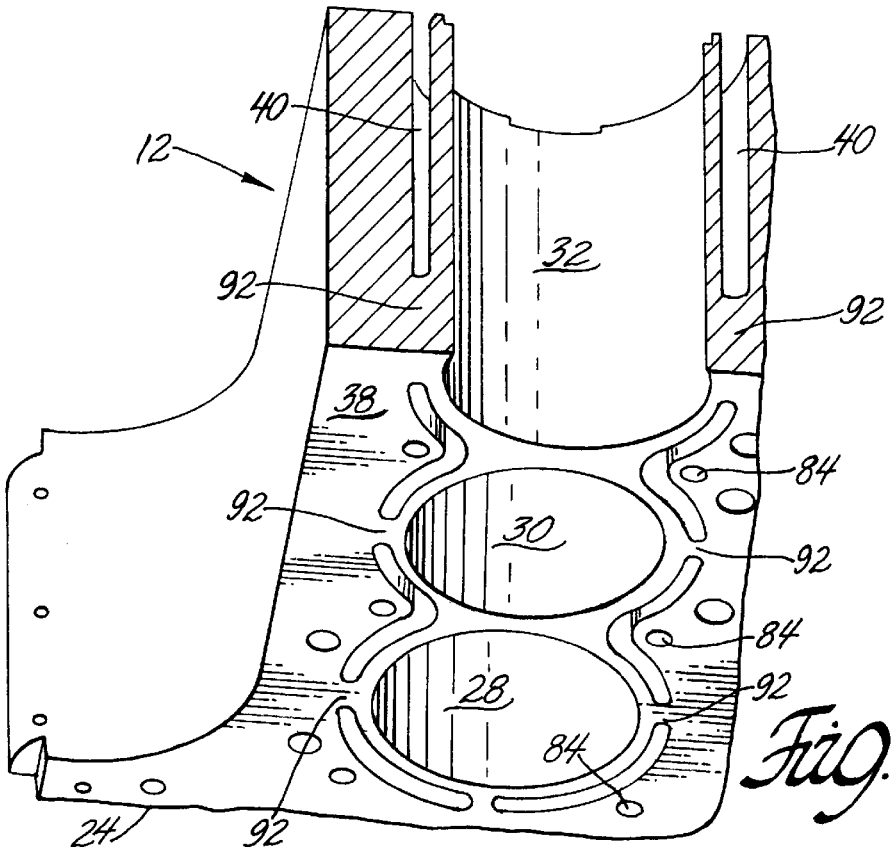
FIG. 3B is a bottom view of a broken-off portion of the cylinder block of FIG. 3A.

FIG. 3B shows more detail of the bottom of a portion of extruded cylinder block 12 adjacent end 24. Cylinder bores 28, 30 and 32 are seen as well as part of the cooling passage 40 surrounding these cylinder bores. In the bottom of the extruded block are ten webs 92 (seven are shown in FIG. 3B) that locate and retain the cylinder bore 28–34 containing structure within the extruded block 12 while leaving ample coolant flow passage 40 volume in the upper hotter portion of the engine component. In this embodiment, two webs are formed on each side of the central two bores 30 and 32 and three webs are extruded between the end cylinder bores (only bore 28 shown) and the adjoining portion of cooling passage 40. The material of the ten webs is initially formed the full length of the cylinder block during extrusion of this component. About 80% of the length of each web material is machined away from passage 40 before engine assembly so that the finished webs 92 extend only about 20% of the height of cylinder block 12. Coolant flow in the upper portion of passage 40 is to remain unimpeded because this flow is adjacent the heated portion of the cylinder bores.

Figure 9:
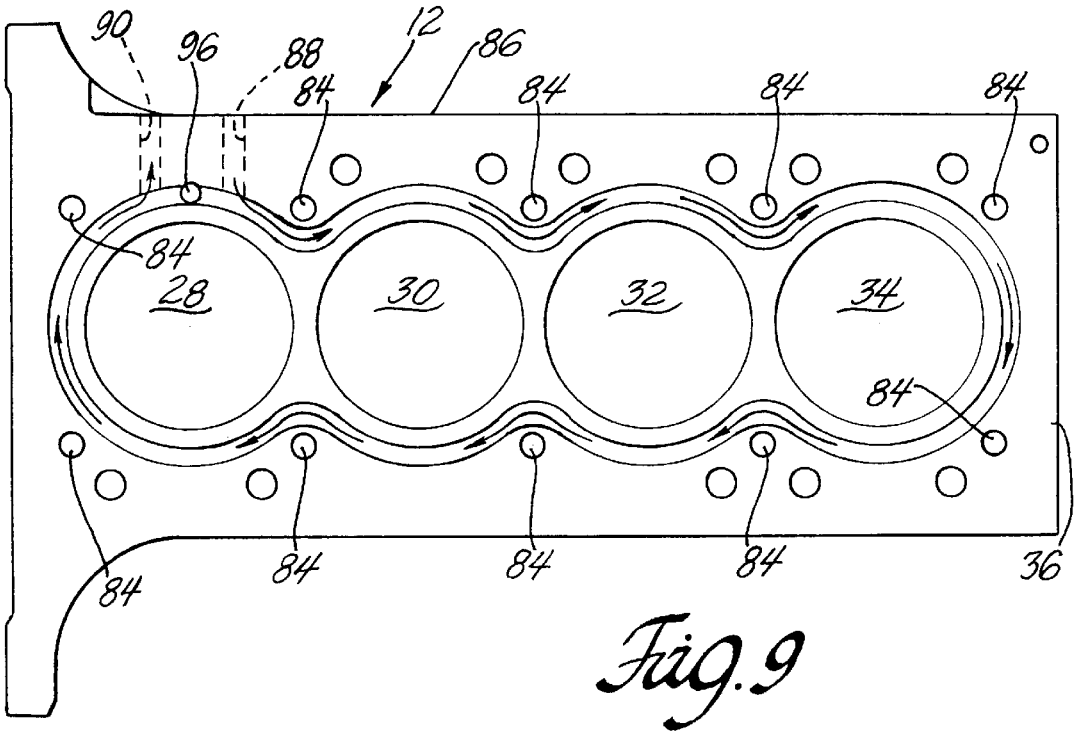
FIG. 9 is a top view of an extruded engine block illustrating coolant flow around the cylinders.

FIG. 9 is a plan view of the top surface 36 of the cylinder bore block. The principal purpose of FIG. 9 is to show a preferred embodiment of the flow of coolant within coolant passage 40 of the cylinder block. It will be recalled that the coolant flow is isolated in the cylinder bore block by suitable gaskets at both its upper surface 36 and lower surface 38. Coolant is circulated with an electric water pump separate from the engine structure and the coolant circulation system is arranged so that coolant flow to the cylinder block and the cylinder head can be controlled separately.

Coolant enters inlet port 88 (FIG. 3A) through a coolant inlet-outlet manifold 94 attached to the side of cylinder block 12 and described below with reference to FIG. 8. As seen in FIG. 9 a rod 96 inserted into coolant passage 40 adjacent bore 28 serves as a coolant inlet-outlet separator. Rod 96 extends vertically the full height of the passage 40 at that location. Thus, the coolant flow is directed from left to right (as seen in FIG. 9) successively past each cylinder bore 28, 30, 32, 34 and around the outside of each cylinder. Since there is no coolant flow channel between the cylinders this cylinder block design is referred to as a Siamese twin design. Preferably, the incoming coolant is directed past the exhaust gas port side of the cylinder bank because the exhaust side is hotter than the intake port side. The coolant thus traverses the length of the block, flowing around end cylinder 34 and then coming back down the intake port side of the block 12 (i.e., U flow path) and around the first cylinder 28 to coolant outlet slot 90. The coolant exits the coolant manifold and is directed to the vehicle radiator.

As stated, an advantage of this modular construction utilizing the extruded cylinder block and mid-plate construction is that segregated or segmented cooling can be employed in the block itself with a separate cooling flow in the cylinder head. Flow can be permitted or stopped separately in each of the cylinder block and the cylinder head in order to maintain more uniform temperature in these components throughout engine operation.

Figure 8:
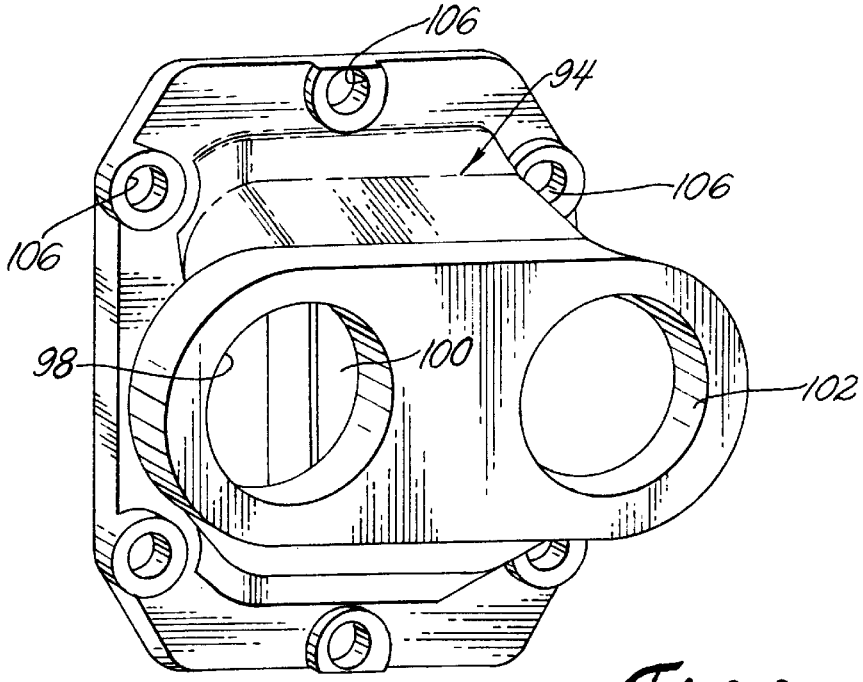
FIG. 8 illustrates a coolant intake/outlet manifold for bolting to the extruded engine bore block.

FIG. 8 illustrates a coolant inlet-outlet manifold 94 casting for attachment to cylinder block 12. It is a simple two part manifold structure with an inlet hole 98, a partition 100 forming two coolant flow volumes within the manifold body 104 an outlet hole 102. Bolt holes 106 of the manifold 94 are shown for accommodating bolting of the manifold 94 to the side 86 of block 12 over slots 88, 90. Corresponding bolt holes 107 are provided in a flat machined region of side wall 86. A gasket should be interposed between the manifold and block for a coolant tight connection. Suitable hoses or the like would be attached to the inlet 98 and outlet 102 for coolant circulation between the water pump, cylinder block and radiator.

FIG. 4 is a perspective plan view of a stamped ferrous or aluminum alloy mid-plate 14. As stated, the mid-plate component is for suitably separating portions of the cylinder block 12 and crankcase 16. It is a flat plate through which round holes 74 are permitted to accommodate the four moving connecting rods. Obviously, one end of each rod is connected to a piston in the cylinder bore and the other end of each rod is connected to the crankshaft in the crankcase. The holes 74 in the mid-plate 14 must be large enough to accommodate the sweep of each connecting rod as it follows its reciprocating piston and contributes to the rotation of the crankshaft.

Mid-plate 14 contains ten bolt holes 108 for through bolts 82 and additional bolt holes for additional bolt connections with the cylinder block and crankcase during engine assembly.

Figure 6:
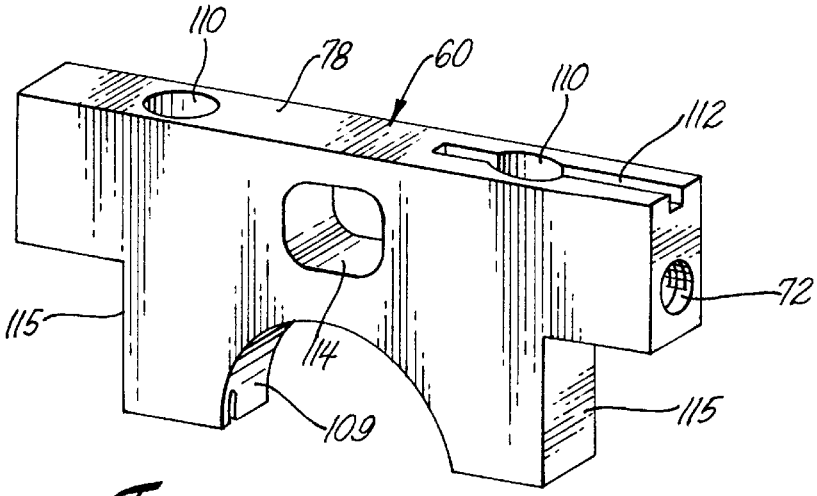
FIG. 6 is a perspective view of a bearing cap of FIG. 2.

FIG. 6 is a perspective view of a representative bearing cap 60. Each cap has a flat upper surface 78 for engagement with mid-plate 14 or an interposed gasket. Each bearing cap also has a half round cylindrical lower surface 109 for engagement with the bearing surface of a crankshaft. Bolt holes 72 are provided in each end for attachment to the wall of the crankcase and bolt holes 110 for through bolt 82 attachment to the underlying bearing support during engine assembly. A crankcase oil channel 112 is formed in top surface 78 of each cast bearing cap 60–68 extending from the channel in the surface to cylindrical surface 109/crankshaft journal interface.

Each bearing cap 60–68 is shaped with ventilation windows 114 to provide fluid flow communication between crankcase volumes created between the bearing supports 50–58/bearing caps 60–68 barriers. These windows in the bearing caps permit crankcase ventilation.

Figure 7:
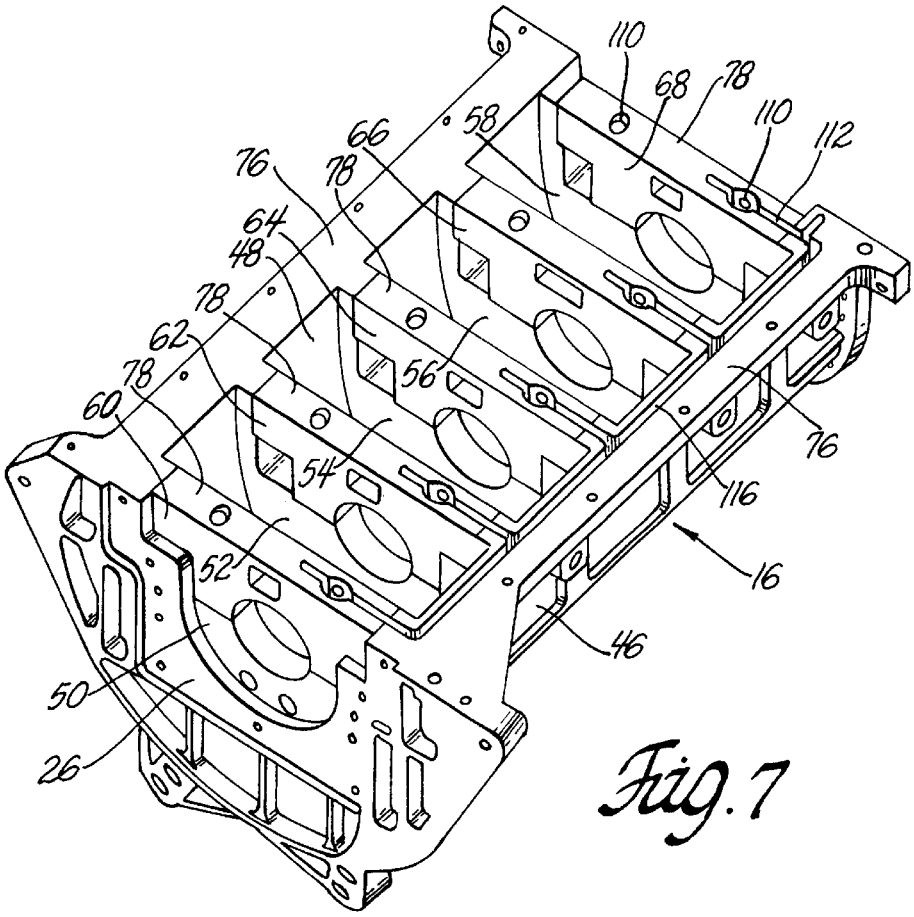
FIG. 7 is a perspective view of an assembly of the crankcase and bearing caps without the crankshaft.

FIG. 7 is a perspective view of the bearing caps 60–68 assembled on the corresponding bearing supports 50–58. This view also shows the crankcase oil channel 116 formed in the top surface of one of the vertical walls of crankcase 16. Thus, lubricating oil is delivered through an oil line (not shown) to channel 116 by a remote oil pump (not shown). The oil flows along channel 116 and into the individual channels 112 on the bearing caps and then to the crankshaft bearing sites. Except for the connecting rod hole 74 openings in the mid-plate 14, the top of the crankcase assembly is closed by mid-plate 14 in the assembled engine. Oil flowing from the crankshaft bearings is thrown upwardly through the openings 74 to provide some lubrication of the piston ring cylinder wall surfaces.

Thus, it is seen that the combination of the cylinder bore block, the mid-plate and the closed bottom crankcase permits these components to be manufactured simply and inexpensively. The separate manufacture of the cylinder bore block, mid-plate and crankcase means that these modular components can each be made of preferred materials and processes for better individual properties.

The modular engine combination also provides for flexibility in the extrusion of cylinder bores of varying length and varying diameters in order to form cylinder blocks accommodating varying engine displacement values. As shown above there can be a variation of 10%–40% in displacement range without requiring a change in the design of the crankcase and without requiring substantial change in the design of the cylinder head. Thus a whole family of engines can be made with simply made structural components to produce engines that are just as efficient and elegant in their operation as the modern automotive engine. Further, the combination of the extruded cylinder bore block and open-top crankcase permits easy assembly of the pistons, connecting rods, crankshaft and crankshaft bearing cups during engine manufacture.

While this invention has been described in terms of a few specific embodiments it will be appreciated if other forms could be readily adapted by those skilled in the art. Accordingly, the scope of the invention is to be limited only by the following claims.

What is claimed is:

1. A reciprocating piston internal combustion engine comprising a cylinder bore block defining at least one cylinder bore and corresponding cylinder coolant passage each extending completely through said block between flat upper and lower surface portions adapted to be sealed to a cylinder head and a crankcase respectively, the diameter of each cylinder bore being adapted to accommodate a piston of specified diameter and the length of each said bore being adapted to accommodate a specified piston stroke;

a crankcase for containing a crankshaft, a connecting rod from said crankshaft to each piston, and crankshaft bearing caps, said crankcase being adapted for location below said cylinder bore block in the operating position of said engine, said crankcase having side walls and a closed bottom for enclosing said crankshaft and an open top for assembly there-through of said crankshaft, connecting rod and bearing caps in said crankcase, the sides of said crankcase having top portions for sealing engagement with said cylinder bore block; and a mid-plate adapted for sealing engagement between said lower surface of said cylinder bore block and said top portions of said crankcase.

2. A reciprocating piston internal combustion engine comprising an extruded metal cylinder bore block defining a plurality of cylinder bores and corresponding cylinder coolant passages all extending completely through said block in the direction of extrusion, said cylinder bore block having flat, upper and lower surface portions adapted to be sealed to a cylinder head and a crankcase respectively, the diameter of each cylinder bore being adapted to accommodate a piston of specified diameter and the length of each said bore being adapted to accommodate a specified piston stroke;

a crankcase for containing a crankshaft, a connecting rod from said crankshaft to each piston, and crankshaft bearing caps, said crankcase being adapted for location below said cylinder bore block in the operating position of said engine, said crankcase having side walls and a closed bottom for enclosing said crankshaft and an open top for assembly there-through of said crankshaft, connecting rods and bearing caps in said crankcase, the sides of said crankcase having top portions for sealing engagement with said cylinder bore block; and a mid-plate adapted for sealing engagement between said lower surface of said cylinder bore block and said top portions of said crankcase.

3. An engine as recited in claim 2 in which said cylinder head, cylinder bore block, mid-plate and crank case are held together in said sealing engagement by a plurality of tie bolts extending from said cylinder head to said crankcase.

4. An engine as recited in either claim 2 or 3 in which said crankcase is formed of cast metal and comprises integral crankshaft bearing supports, complementary in shape to said bearing caps, formed in the bottom of said case.

5. An engine as recited in either claim 2 or 3 comprising a coolant sealing gasket between said extruded cylinder bore block and said mid-plate and an oil sealing gasket between said mid-plate and said crankcase top portions.

6. An engine as recited in either claim 2 or 3 in which said cylinder bore block wall comprises a coolant inlet in a side of said block leading to said coolant passage and a coolant outlet in said side of said block leading from said passage, said inlet and outlet being located in said side so that the coolant flows past each cylinder before exiting.

7. An engine as recited in either claim 2 or 3 in which said cylinder bore block wall comprises a coolant inlet in a side of said block leading to said coolant passage, a coolant outlet in said side of said block leading from said passage, and a partition in said passage separating said inlet from said outlet; said inlet and outlet being located in said side so that the coolant flows past each cylinder before exiting.

8. A method of making, on a single manufacturing line or in a single manufacturing cell, different members of a family of two or more multi-cylinder, reciprocating piston, internal combustion engines differing in specified piston displacement values, said method comprising selecting for each said engine an extruded metal cylinder bore block defining a plurality of cylinder bores all extending completely through said block in the direction of extrusion, said cylinder bore block having flat, upper and lower surface portions adapted to be sealed to a cylinder head and a crankcase respectively, the diameter of each cylinder bore being adapted to accommodate a piston of specified diameter and the length of each said bore being adapted to accommodate a specified piston stroke to produce the displacement value for the engine family member currently being made;

using a cylinder head for the engine family member currently being made;

using a common crankcase for each said member of said family of engines, said crankcase having a closed bottom with side and end walls shaped to contain a crankshaft, and piston connecting rods selected for the engine currently being made, said crankcase having an open top and said walls having flat, co-planar surfaces for sealing engagement with said cylinder bore block;

selecting a mid-plate adapted for sealing engagement between said cylinder bore block and said surfaces of said crankcase, and assembling said cylinder head, said selected cylinder bore block, said mid-plate and said common crankcase in an engine structure in making members of said engine family.

9. A method as recited in claim 8 in which the selected cylinder bore block comprises a coolant passage extending completely through said block in the direction of extrusion for cooling said cylinder bores.

10. A method of making, on a single manufacturing line or in a single manufacturing cell, different members of a family of two or more multi-cylinder, reciprocating piston, internal combustion engines differing in specified piston displacement values, said method comprising selecting for each said engine an extruded metal cylinder bore block defining a plurality of cylinder bores and corresponding coolant passage all extending completely through said block in the direction of extrusion, said cylinder bore block having flat, upper and lower surface portions adapted to be sealed to a cylinder head and a crankcase respectively, the diameter of each cylinder bore being adapted to accommodate a piston of specified diameter and the length of each said bore being adapted to accommodate a specified piston stroke to produce the specified displacement value for the engine family member currently being made;

using a cylinder head for the engine family member currently being made;

using a common cast crankcase for each said member of said family of engines, said crankcase having (1) a closed bottom with integral bearing supports for a crankshaft, (2) side and end walls shaped to contain said crankshaft, crankshaft bearing caps, and piston connecting rods selected for the engine currently being made, and (3) an open top, and said walls having flat, co-planar surfaces for sealing engagement with said cylinder bore block;

selecting a mid-plate adapted for sealing engagement between said cylinder bore block and said surfaces of said crankcase, and assembling said crankshaft, bearing caps and connecting rods through the top of said common crankcase without inverting the crankcase and further assembling said cylinder head, said selected cylinder bore block, and said mid-plate with said crankcase in an engine structure in making members of said engine family.

11. An engine as recited in claim 1 in which said crankcase comprises an integral oil channel for delivery of lubricating oil to said crank shaft through oil channels in assembled said bearing caps.

12. An engine as recited in claim 2 in which said crankcase comprises an integral oil channel for delivery of lubricating oil to said crank shaft through oil channels in assembled said bearing caps.

* * * * *